US009546804B2

(12) United States Patent
Troutman et al.

(10) Patent No.: US 9,546,804 B2
(45) Date of Patent: Jan. 17, 2017

(54) MICROCHANNEL COIL SPRAY SYSTEM

(75) Inventors: Stephen Troutman, Stone Mountain, GA (US); Chris Jentzsch, Snellville, GA (US); Dustan Atkinson, Stone Mountain, GA (US); Lindsay Harry, Atlanta, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 1081 days.

(21) Appl. No.: 12/750,902

(22) Filed: Mar. 31, 2010

(65) Prior Publication Data

US 2011/0138823 A1 Jun. 16, 2011

Related U.S. Application Data

(60) Provisional application No. 61/286,856, filed on Dec. 16, 2009.

(51) Int. Cl.

| | |
|---|---|
| ***F25B 47/00*** | (2006.01) |
| ***F28D 5/00*** | (2006.01) |
| ***F28C 1/00*** | (2006.01) |
| ***F25B 39/04*** | (2006.01) |
| ***F28B 1/06*** | (2006.01) |
| ***F28D 5/02*** | (2006.01) |
| ***F28F 9/013*** | (2006.01) |

(52) U.S. Cl.

CPC ..... *F25B 39/04* (2013.01); *F28B 1/06* (2013.01); *F28D 5/02* (2013.01); *F28F 9/013* (2013.01); *F25B 2339/041* (2013.01); *F28F 2260/02* (2013.01)

(58) Field of Classification Search

CPC ..... F25B 2313/0314; F25B 47/00; F28D 5/00; F28D 5/02; F28C 1/00

USPC ..... 62/280, 279, 305; 165/908

See application file for complete search history.

(56) References Cited

U.S. PATENT DOCUMENTS

| | | | | |
|---|---|---|---|---|
| 2,752,124 | A * | 6/1956 | Nofziger | F28D 5/02 261/29 |
| 3,903,213 | A * | 9/1975 | Stover | 261/30 |
| 6,484,527 | B1 * | 11/2002 | Paul | 62/305 |
| 6,655,162 | B2 * | 12/2003 | McKee | 62/305 |
| 6,761,039 | B1 * | 7/2004 | Gray | 62/279 |
| 7,234,316 | B2 * | 6/2007 | Tien | 62/305 |
| 2005/0039892 | A1 * | 2/2005 | Calton et al. | 165/122 |
| 2005/0161202 | A1 * | 7/2005 | Merkys | F25B 39/04 165/122 |
| 2006/0168981 | A1 * | 8/2006 | Mager et al. | 62/310 |
| 2007/0022774 | A1 * | 2/2007 | Liu | 62/305 |
| 2007/0101746 | A1 * | 5/2007 | Schlom et al. | 62/310 |
| 2008/0022709 | A1 * | 1/2008 | McKee | 62/314 |
| 2009/0084131 | A1 | 4/2009 | Reifel et al. | |

(Continued)

FOREIGN PATENT DOCUMENTS

| | | |
|---|---|---|
| EP | 1 557 622 A2 | 7/2005 |
| FR | 2 923 594 A1 | 5/2009 |

(Continued)

*Primary Examiner* — Frantz Jules
*Assistant Examiner* — Erik Mendoza-Wilkenfe
(74) *Attorney, Agent, or Firm* — Baker Botts L.L.P.

(57) ABSTRACT

The present application provides a microchannel coil assembly. The microchannel coil assembly may include a frame, a number of microchannel coils positioned within the frame, and a microchannel coil spray system positioned about the frame and the number of microchannel coils.

14 Claims, 4 Drawing Sheets

(56) References Cited

U.S. PATENT DOCUMENTS

| | | | |
|---|---|---|---|
| 2010/0254081 | A1 | 10/2010 | Koenig et al. |
| 2010/0294460 | A1 | 11/2010 | Duchet-Annez et al. |
| 2011/0056668 | A1 | 3/2011 | Taras et al. |

FOREIGN PATENT DOCUMENTS

| | | | |
|---|---|---|---|
| JP | 2001124490 | A | 5/2001 |
| WO | 2009/007168 | A1 | 1/2009 |
| WO | 2009/134760 | A2 | 5/2009 |

* cited by examiner

MICROCHANNEL COIL SPRAY SYSTEM

RELATED APPLICATIONS

The present application claims priority to U.S. Provisional Application Ser. No. 61/286,856 filed on Dec. 16, 2009. This application is incorporated herein by reference in full.

TECHNICAL FIELD

The present application relates generally to air conditioning and refrigeration systems and more particularly relates to an integrated spray system for use with microchannel coils so as to wash the coils and also to provide cooling.

BACKGROUND OF THE INVENTION

Modern air conditioning and refrigeration systems provide cooling, ventilation, and humidity control for all or part of an enclosure such as a building, a cooler, and the like. Generally described, the refrigeration cycle includes four basic stages to provide cooling. First, a vapor refrigerant is compressed within a compressor at high pressure and heated to a high temperature. Second, the compressed vapor is cooled within a condenser by heat exchange with ambient air drawn or blown across a condenser coil by a fan and the like. Third, the liquid refrigerant is passed through an expansion device that reduces both the pressure and the temperature of the liquid refrigerant. The liquid refrigerant is then pumped within the enclosure to an evaporator. The liquid refrigerant absorbs heat from the surroundings in an evaporator coil as the liquid refrigerant evaporates to a vapor. Finally, the vapor is returned to the compressor and the cycle repeats. Various alternatives on this basic refrigeration cycle are known and also may be used herein.

Traditionally, the heat exchangers used within the condenser and the evaporator have been common copper tube and fin designs. These heat exchanger designs often were simply increased in size as cooling demands increased. Changes in the nature of the refrigerants permitted to be used, however, have resulted in refrigerants with distinct and sometimes insufficient heat transfer characteristics. As a result, further increases in the size and weight of traditional heat exchangers also have been limited within reasonable cost ranges.

As opposed to copper tube and fin designs, recent heat exchanger designs have focused on the use of aluminum microchannel coils. Microchannel coils generally include multiple flat tubes with small channels therein for the flow of refrigerant. Heat transfer is then maximized by the insertion of angled and/or louvered fins in between the flat tubes. The flat tubes are then joined with a number of manifolds. Compared to known copper tube and fin designs, the air passing over the microchannel coil designs has a longer dwell time so as to increase the efficiency and the rate of heat transfer. The increase in heat exchanger effectiveness also allows the microchannel heat exchangers to be smaller while having the same or improved performance and the same volume as a conventional heat exchanger. Microchannel coils thus provide improved heat transfer properties with a smaller size and weight, provide improved durability and serviceability, improved corrosion protection, and also may reduce the required refrigerant charge by up to about fifty percent (50%).

Known copper fin and tube designs generally have issues with the possibility of galvanic corrosion. Such corrosion may be accelerated in the presence of water. Proper cleaning of the fin and tube designs thus was often difficult and time consuming. Reduced cleaning, however, could lead to reduced overall system efficiency because of debris trapped therein.

There is thus a desire for an improved microchannel heat exchanger design. Preferably such a microchannel heat exchanger could be routinely and quickly cleaned without the potential for galvanic corrosion or other types of damage or a lessened efficiency.

SUMMARY OF THE INVENTION

The present application thus provides a microchannel coil assembly. The microchannel coil assembly may include a frame, a number of microchannel coils positioned within the frame, and a microchannel coil spray system positioned about the frame and the number of microchannel coils.

The microchannel coil spray system may include a number of nozzles. The number of nozzles may be supported by a number of beams. The beams may be connected to the frame. The microchannel coil spray system may include a spray about the number of microchannel coils. The spray may include a water spray, a cleaning spray, or a cooling spray.

One or more fans may be positioned about the frame. The microchannel coil spray system may be positioned beneath the one or more fans. The microchannel coil assembly further may include a controller in communication with the microchannel coil spray system. The microchannel coils may be made out of an aluminum material and the like.

The present application further provides a method of operating a microchannel coil assembly. The method may include the steps of securing a number of spray nozzles about a number of microchannel coils and providing a spray to the microchannel coils based upon a predetermined event. The predetermined event may include a predetermined amount of time, a predetermined temperature, a predetermined load on the number of microchannel coils, or a visual inspection of the microchannel coils. The step of providing a spray may include providing a water spray, a cleaning spray, or a cooling spray.

The present application further may provide a microchannel coil assembly. The microchannel coil assembly may include a frame, a number of microchannel coils positioned within the frame, and a number of spray nozzles positioned about the frame and above the microchannel coils so as to provide a spray thereto.

The spray may include a water spray, a cleaning spray, or a cooling spray. The spray nozzles may be supported by a number of beams connected to the frame. The microchannel coils may be made out of an aluminum material and the like. The microchannel coil assembly further may include a controller in communication with the spray nozzles.

These and other features and improvements of the present application will become apparent to one of ordinary skill in the art upon review of the following detailed description when taken in conjunction with the following drawings and the appended claims.

DETAILED DESCRIPTION

Figure 1:
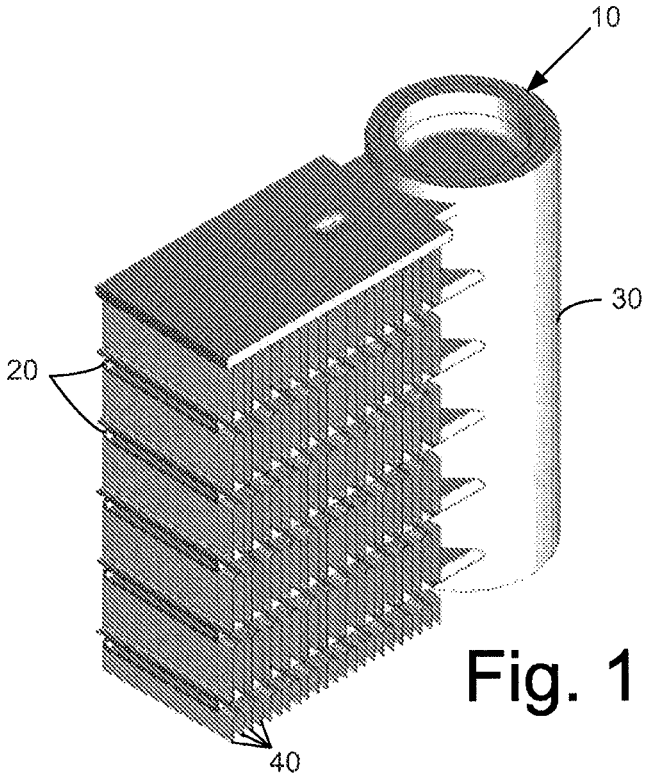
FIG. 1 is a perspective view of a portion of a microchannel coil as may be used herein.
Figure 2:
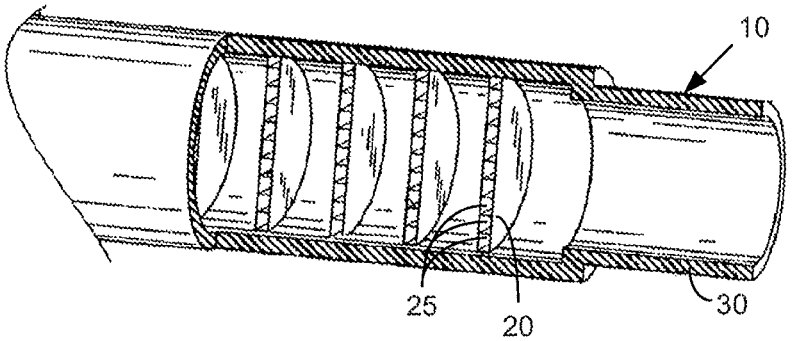
FIG. 2 is a side cross-sectional view of a portion of the microchannel coil of FIG. 1.

Referring now to the drawings, in which like numerals refer to like elements throughout the several views, FIGS. 1 and 2 show a portion of a known microchannel coil 10 similar to that described above. Specifically, the microchannel coil 10 may include a number of microchannel tubes 20 with a number of microchannels 25 therein. The microchannel tubes 20 generally are elongated and substantially flat. Each microchannel tube 20 may have any number of microchannels 25 therein. A refrigerant flows through the microchannels 25 in various directions.

The microchannel tubes 20 generally extend from one or more manifolds 30. The manifolds 30 may be in communication with the overall air-conditioning system as is described above. Each of the microchannel tubes 20 may have a number of fins 40 positioned thereon. The fins 40 may be straight or angled. The combination of a number of small tubes 20 with the associated high density fins 40 thus provides more surface area per unit volume as compared to known copper fin and tube designs for improved heat transfer. The fins 40 also may be louvered over the microchannel tubes 20 for an even further increase in surface area. The overall microchannel coil 10 generally is made out of extruded aluminum and the like.

Examples of known microchannel coils 10 include those offered by Hussmann Corporation of Bridgeton, Missouri; Modine Manufacturing Company of Racine, Wis.; Carrier Commercial Refrigeration, Inc. of Charlotte, N.C.; Delphi of Troy, Michigan; Danfoss of Denmark; and from other sources. The microchannel coils 10 generally may be provided in standard or predetermined shapes and sizes. Any number of microchannel coils 10 may be used together, either in parallel, series, or combinations thereof. Various types of refrigerants may be used herein.

Figure 3:
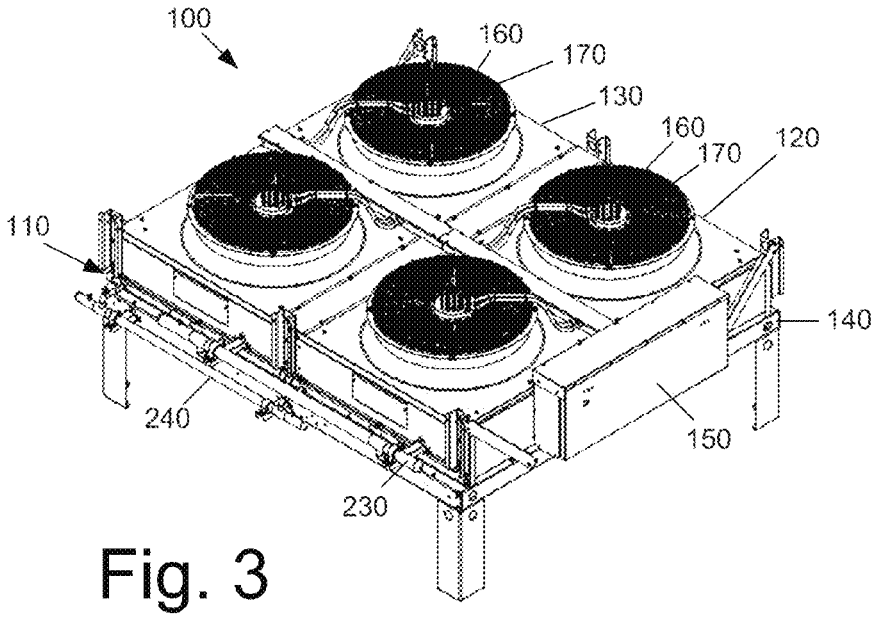
FIG. 3 is a perspective view of a microchannel condenser assembly as is described herein.

FIG. 3 shows a microchannel condenser assembly 100 as may be described herein. The microchannel condenser assembly 100 may include a number of microchannel coils 110. The microchannel coils 110 may be similar to the microchannel coil 10 described above or otherwise. Although two (2) microchannel coils 110 are shown, a first microchannel coil 120 and a second microchannel coil 130, any number of microchannel coils 110 may be used herein. As described above, the microchannel coils 110 may be connected in series, in parallel, or otherwise.

The microchannel coils 110 may be supported by a frame 140. The frame 140 may have any desired shape, size, or configuration. The frame 140 also may be modular as is described in more detail below. Operation of the microchannel coils 110 and the microchannel condenser assembly 100 as a whole may be controlled by a controller 150. The controller 150 may or may not be programmable. A number of fans 160 may be positioned about each microchannel coil 110 and the frame 140. The fans 160 may direct a flow of air across the microchannel coils 110. Any number of fans 160 may be used herein. Other types of air movement devices also may be used herein. Each fan 160 may be driven by an electrical motor 170. The electrical motor 170 may operate via either an AC or a DC power source. The electrical motors 170 may be in communication with the controller 150 or otherwise.

Figure 4:
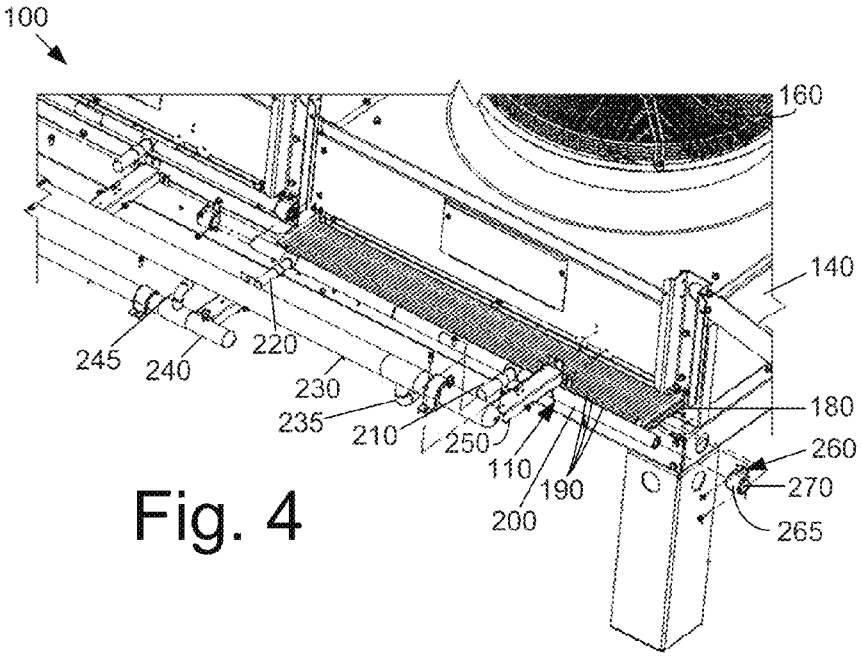
FIG. 4 is a partial exploded view of a microchannel coil being installed within the microchannel condenser assembly of FIG. 3.

FIG. 4 shows the insertion of one of the microchannel coils 110 into a slot 180 within the frame 140 of the microchannel condenser assembly 100. As is shown and as is described above, the microchannel coil 110 includes a number of microchannel tubes 190 in communication with a coil manifold 200. The coil manifold 200 has at least one coil manifold inlet 210 and at least one a coil manifold outlet 220. Refrigerant passes into the microchannel coil 110 via the coil manifold inlet 210, passes through the microchannel tubes 190 with the microchannels therein, and exits via the coil manifold outlet 220. The refrigerant may enter as a vapor and exit as a liquid as the refrigerant exchanges heat with the ambient air. The refrigerant also may enter as a liquid and continue to release heat therein.

The microchannel condenser assembly 100 likewise may include an assembly inlet manifold 230 with an assembly inlet connector 235 and an assembly outlet manifold 240 with an assembly outlet connector 245. The assembly inlet manifold 230 is in communication with the coil manifold 200 via the coil manifold inlet 210 and the assembly inlet connector 235 while the assembly outlet manifold 240 is in communication with the coil manifold 200 via the coil outlet manifold 220 and the assembly outlet connector 245. Other connections may be used herein. The assembly manifolds 230, 240 may be supported by one or more brackets 250 or otherwise. The assembly manifolds 230, 240 may be in communication with other elements of the overall refrigeration system as was described above.

The coil manifold inlets and outlets 210, 220 and/or the assembly connectors 235, 245 may include stainless steel with copper plating at one end. The coil inlets and outlets 210, 220 and the assembly connectors 235, 245 may be connected via a brazing or welding operation and the like. Because the copper and the aluminum do not come in contact with one another, there is no chance for galvanic corrosion and the like. Other types of fluid-tight connections and/or quick release couplings also may be used herein.

Figure 5:
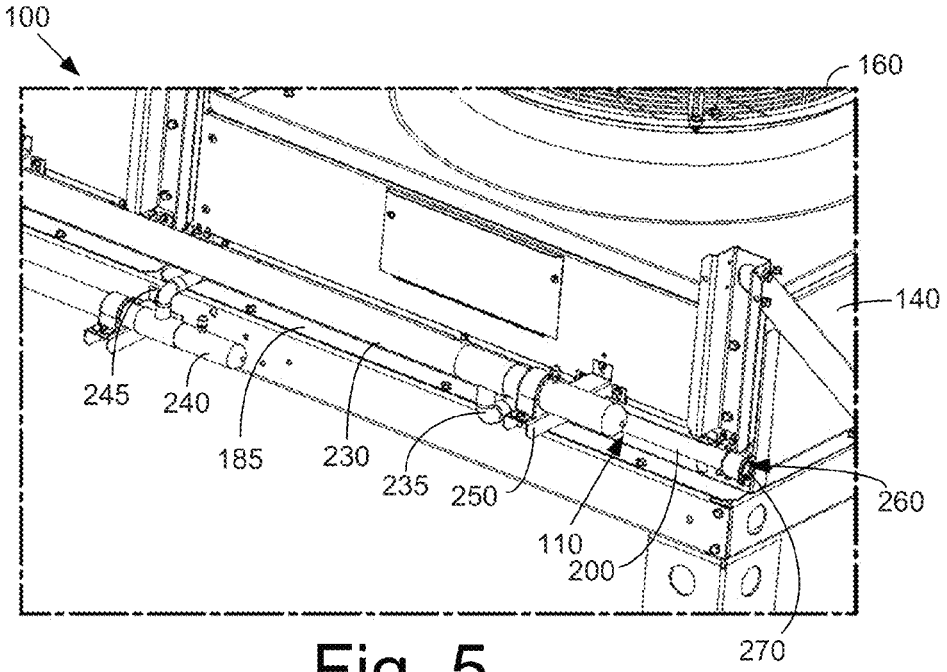
FIG. 5 is a partial perspective view of the microchannel coil installed at a first end of the microchannel condenser assembly of FIG. 3.

FIG. 5 shows one of the microchannel coils 110 installed within the slot 180 of the frame 140 at a first end 185 thereof. As described above, the coil manifold 200 may be in communication with the assembly inlet and outlet manifolds 230, 240. The coil manifold 200 also may be attached to the frame 140 at the first end 185 via a coil attachment 260. The coil attachment 260 may include a clamp 265 that surrounds the coil manifold 200 and is secured to the frame 140 via screws, bolts, other types of fasteners, and the like. Other shapes may be used herein. A rubber or polymeric bushing 270 also may be used between the manifold 200 and the clamp 265 so as to dampen any vibrations therein. Other types of isolation means may be used herein.

Figure 6:
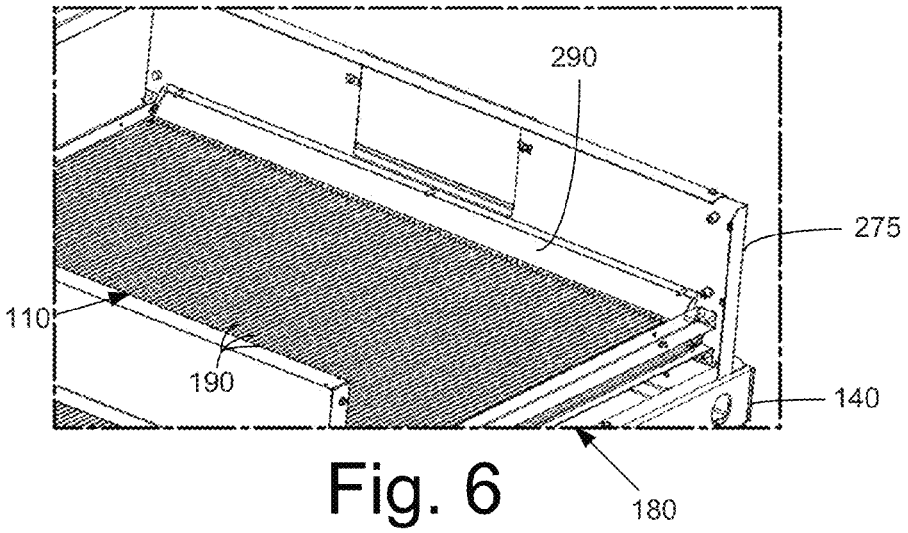
FIG. 6 is a partial perspective view of the microchannel coil attached at a second end of the microchannel condenser assembly of FIG. 3.

FIG. 6 shows the opposite end of the microchannel coil 110 as installed within the slot 180 at a second end 275 of the frame 140. The slot 180 may extend for the length of the frame 140 or otherwise. The microchannel coil 110 may slide along the slot 180. Alternatively, wheels and/or other types of motion assisting devices may be used herein. The microchannel coil 110 may be held in place via a rear bracket or a tab 290. The rear bracket 290 may be any structure that secures the microchannel coil 110 in place. The rear bracket 290 may be secured to the back of the frame 140 once the microchannel coil 110 has been slid therein. Other types of attachment means and/or fasteners may be used herein.

Figure 7:
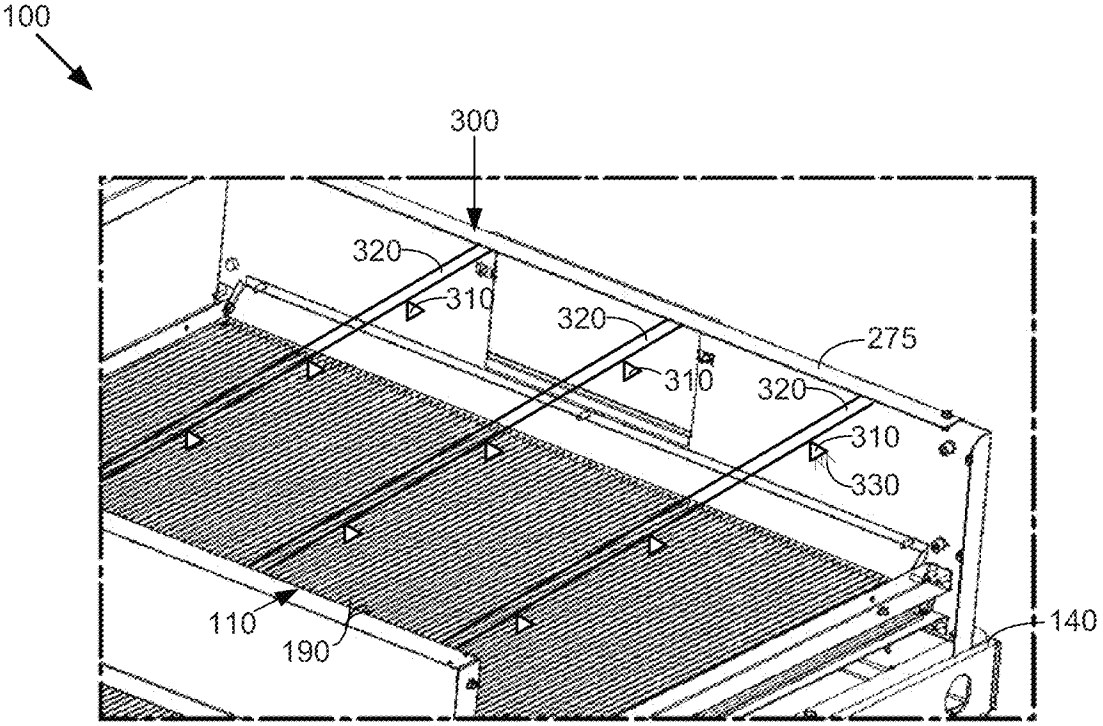
FIG. 7 is a partial perspective view of a microchannel coil wash system as is described herein.

FIG. 7 shows a microchannel coil spray system 300 as may be described herein. As is shown, the microchannel coil spray system 300 may include a number of spray nozzles 310. The spray nozzles 310 may be positioned about a number of support beams 320 or other types of supports positioned about the frame 140 or otherwise. The spray nozzles 310 and the support beams 320 may extend over the microchannel coils 110 so as to apply a spray 330 of water or other type of fluid to the microchannel tubes 190 and the associated fins 40. Specifically, the spray 330 may be water, a cleaning solution, a cooling solution, and the like. The spray nozzle 310 and the support beams 320 preferably are located underneath the fans 160 so as to provide the spray 330 directly onto the microchannel coils 110 or otherwise as desired.

The microchannel spray system 300 may use any other type of water delivery system to apply a pressured or nonpressured spray 330 to the microchannel coils 110. The microchannel coil spray system 300 may be original equipment or may be retrofitted therein. The microchannel coil spray system 300 may be operated by the controller 150 or by a similar device. Operation of the microchannel spray system 300 may be based on a predetermined event such as on a scheduled basis, a temperature basis, a load basis, and/or on an as needed based upon, for example, a visual inspection or on overall operating conditions. Other triggering events may be used herein.

In addition to cleaning the microchannel coils 110, the microchannel coil spray system 300 also may serve to cool the microchannel coils 110. As a result, a spray 330 onto the microchannel coils 110 may be provided during, for example, high temperature or high load operations, so as to increase the capacity of the microchannel condenser assembly 100 as a whole. The microchannel coil spray system 300 thus may function in a manner similar to an evaporative condenser in that providing the spray 330 to the condensing surface may increase the overall capacity therein by removing additional heat from the microchannel coils 110. Decreases in the operational efficiency of the microchannel condenser assembly 100 also may trigger the operation of the microchannel coil spray system 300 as detected by, for example, the controller 150 or otherwise.

Because the microchannel coils 110 are made out of an aluminum material, the possibility of galvanic corrosion is greatly decreased. Further, frequent cleaning of the overall microchannel condenser assembly 100 should maintain an optimum operating capacity.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A microchannel coil assembly, comprising:
a frame;
a plurality of microchannel coils positioned within the frame;
a microchannel coil spray system positioned about the frame and above the plurality of microchannel coils, the microchannel coil spray system configured to provide a spray to the plurality of microchannel coils;
a controller in communication with the microchannel coil spray system; and
one or more fans positioned above the microchannel spray system, the one or more fans configured to direct air downward across the plurality of microchannel coils;
wherein the controller is configured to operate the microchannel coil spray system based on a predetermined event and the predetermined event is a temperature of the plurality of microchannel coils.

2. The microchannel coil assembly of claim 1, wherein the microchannel coil spray system comprises a plurality of nozzles.

3. The microchannel coil assembly of claim 2, wherein the plurality of nozzles is supported by a plurality of beams.

4. The microchannel coil assembly of claim 3, wherein the plurality of beams is connected to the frame.

5. The microchannel coil assembly of claim 1, wherein the spray comprises a water spray, a cleaning spray, or a cooling spray.

6. The microchannel coil assembly of claim 1, wherein the plurality of microchannel coils comprises an aluminum.

7. A microchannel coil assembly, comprising:
a frame;
a plurality of microchannel coils positioned within the frame;
a plurality of spray nozzles positioned about the frame and above the plurality of microchannel coils, the plurality of spray nozzles configured to provide a spray to the plurality of microchannel coils;
a controller in communication with the plurality of spray nozzles; and
one or more fans positioned above the microchannel coil spray system, the one or more fans configured to direct air downward across the plurality of microchannel coils;
wherein the controller is configured to operate the plurality of spray nozzles based on a predetermined event and the predetermined event is a temperature of the plurality of microchannel coils.

8. The microchannel coil assembly of claim 7, wherein the spray comprises a water spray, a cleaning spray, or a cooling spray.

9. The microchannel coil assembly of claim 7, wherein the plurality of spray nozzles are supported by a plurality of beams connected to the frame.

10. The microchannel coil assembly of claim 7, wherein the plurality of microchannel coils comprises an aluminum.

11. The microchannel coil assembly of claim 1, wherein the predetermined event is based on a load of the plurality of microchannel coils.

12. The microchannel coil assembly of claim 1, wherein operation of the microchannel coil spray system removes heat from the plurality of microchannel coils.

13. The microchannel coil assembly of claim 7, wherein the predetermined event is based on a load of the plurality of microchannel coils.

14. The microchannel coil assembly of claim 7, wherein operation of the plurality of spray nozzles removes heat from the plurality of microchannel coils.

* * * * *